United States Patent [19]

Sze et al.

[11] 4,326,853

[45] Apr. 27, 1982

[54] COKE PRODUCTION FROM LIQUID DERIVED FROM SUB-BITUMINOUS AND/OR LIGNITIC COAL

[75] Inventors: Morgan C. Sze, Upper Montclair; Andre A. Simone, Denville, both of N.J.

[73] Assignee: The Lummus Company, Bloomfield, N.J.

[21] Appl. No.: 131,933

[22] Filed: Mar. 21, 1980

Related U.S. Application Data

[63] Continuation-in-part of Ser. No. 942,025, Sep. 13, 1978, abandoned.

[51] Int. Cl.[3] ..... C10L 9/00

[52] U.S. Cl. ..... 44/1 F; 44/1 A; 201/22; 208/8 LE

[58] Field of Search ..... 208/8 R, 8 LE, 80, 131; 423/445, 450; 44/1 F, 1 A, 10 C, 10 K; 201/22, 25

[56] References Cited

U.S. PATENT DOCUMENTS

| | | | |
|---|---|---|---|
| 3,109,803 | 11/1963 | Bloomer et al. | 208/8 LE |
| 3,240,566 | 3/1966 | Bullough et al. | 208/8 LE |
| 3,933,443 | 1/1976 | Lohrmann | 44/1 F |
| 4,028,221 | 6/1977 | Sze et al. | 208/8 LE |
| 4,201,655 | 5/1980 | Theodore et al. | 201/22 X |

*Primary Examiner*—Carl F. Dees

*Attorney, Agent, or Firm*—Louis E. Marn; Elliot M. Olstein

[57] ABSTRACT

In the liquefaction of a sub-bituminous and/or lignitic coal, an ash containing coal liquid is heated to a temperature of from 410° C. to 450° C., and delayed coked adiabatically at a pressure of from 15 psig to 120 psig to produce an ash containing soft coke, having a volatile matter content of above 16% and generally no greater than 30%, all by weight, which is particularly suitable as a blending stock for the production of metallurgical coke.

17 Claims, 1 Drawing Figure

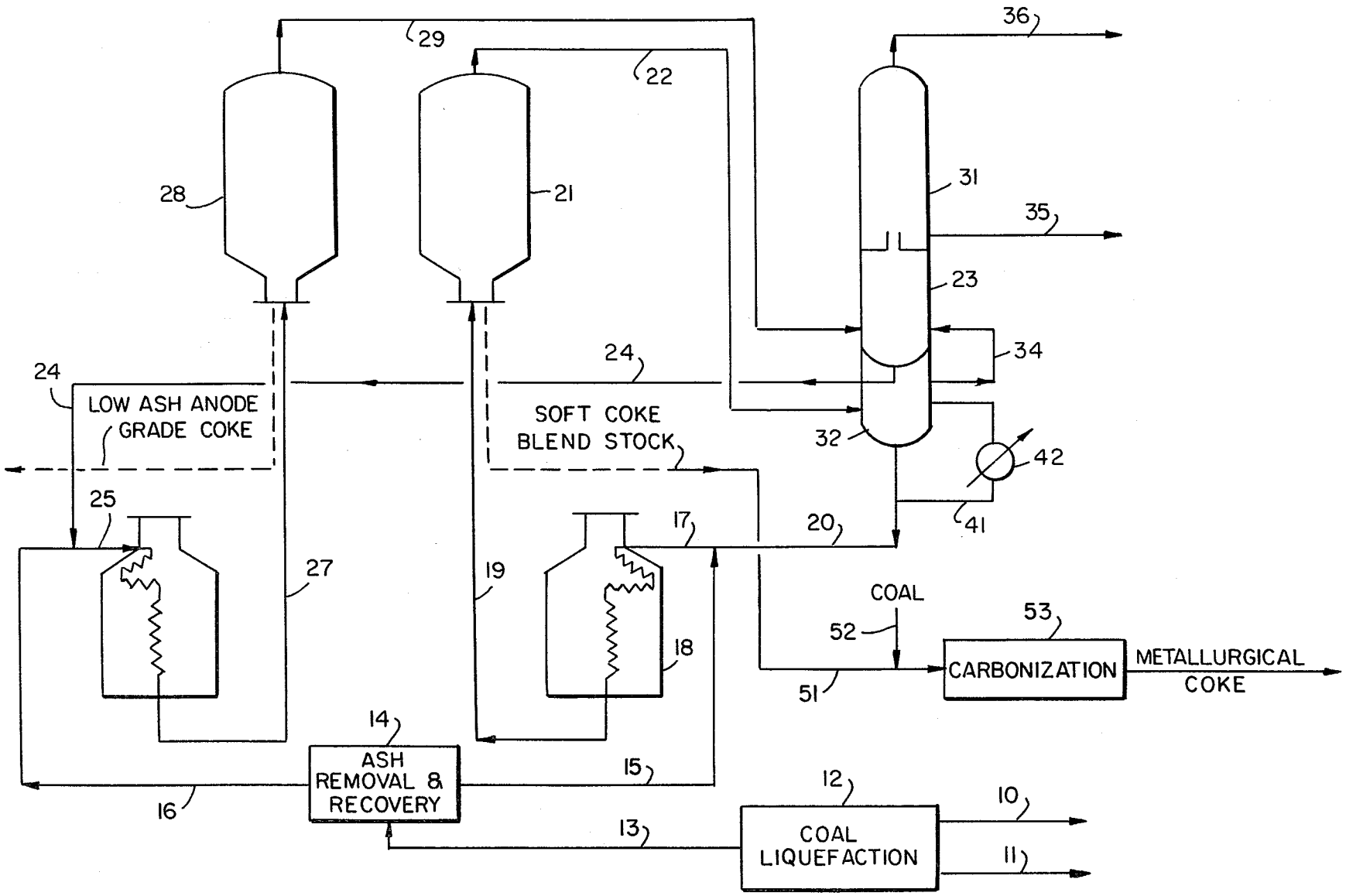
METALLURGICAL COKE
CARBONIZATION
COAL
COAL LIQUEFACTION
ASH REMOVAL & RECOVERY
SOFT COKE BLEND STOCK
LOW ASH ANODE GRADE COKE
10
11
12
13
14
15
16
17
18
19
20
21
22
23
24
25
27
28
29
31
32
34
35
36
41
42
51
52
53

COKE PRODUCTION FROM LIQUID DERIVED FROM SUB-BITUMINOUS AND/OR LIGNITIC COAL

This application is a continuation-in-part of U.S. application Ser. No. 942,025, filed on Sept. 13, 1978 and now abandoned.

This invention relates to the liquefaction of a sub-bituminous and/or lignitic coal, and more particularly to the production of coke from a coal liquid derived from such liquefaction.

In U.S. Pat. No. 4,028,221, there is disclosed a process for the liquefaction of a sub-bituminous and/or lignitic coal. The patent further describes separation of such liquefied coal into an ash-free liquid coal fraction, and an ash-containing liquid coal fraction. It is further indicated that the ash-containing coal liquid fraction may be subjected to coking and/or gasification.

In accordance with the present invention, it has been found that an ash-containing liquid coal fraction derived from a process for liquefying a low ash content sub-bituminous and/or lignitic coal can be effectively subjected to delayed coking, at specified conditions, in order to produce a soft coke particularly suitable for a blend stock for the production of metallurgical coke.

More particularly, the ash-containing coal liquid is introduced into a coking heater wherein the liquid is heated to a temperature in the order of from about 410° C. to about 450° C., preferably from about 415° C. to about 435° C. The heated coal liquid is then introduced into a coking drum wherein delayed coking is effected adiabatically at a pressure of from about 15 psig to about 120 psig, and preferably from about 30 psig to about 50 psig. The temperature conditions are particularly selected in order to produce a soft coke having a volatile matter content of above 16% and generally no greater than 30%, all by weight, which can be employed as a blending stock in the production of metallurgical coke, with the lower temperatures producing the higher volatile matter contents.

Thus, the heater outlet temperature is controlled to produce a soft coke having a combustible volatile matter content of from above 16 to 30 weight percent.

The ash content of the soft coke is dependent upon the ash content of the coal employed as starting material and the severity of the liquefaction. In general, the coal preferably has an ash content of from 1 to 3 percent by weight (dry basis). The soft coke generally has an ash content of from 6 to 20 percent, by weight, on a dry basis.

As hereinabove noted, the starting material for the liquefaction process is either a sub-bituminous coal, i.e., those coals having an ASTM classification of III and lignitic coals, i.e., coals having an ASTM rank of IV, with the preferred coal being either brown coal or lignite. The coal is subjected to a liquefaction process, and in particular to a liquefaction process as described in U.S. Pat. No. 4,028,221, which is hereby incorporated by reference. As disclosed in such patent, the coal is generally initially partially de-oxygenated or de-carboxylated by heat soaking, with elimination of carbon dioxide, water and smaller amounts of carbon monoxide as the principal products. The heat soaking is generally effected at a temperature of at least 500° F., generally in the order of from about 550° F. to about 750° F., and at a pressure of less than 300 psig, generally in the order of from 30 psig to about 300 psig.

The coal is then subjected to a hydroliquefaction process, which is preferably in an indigenous pasting solvent, i.e., a pasting solvent derived from the sub-bituminous and/or lignitic coals, with the pasting solvent containing at least 25 percent by weight, of components boiling above 800° F., and preferably from about 35 to about 70 percent by weight, of components boiling above 800° F. The pasting solvent generally has a 5 volume percent distillation temperature of at least about 550° F., although lower boiling components may also be included in the pasting solvent.

The hydroliquefaction is generally effected at a temperature from about 600° F. to about 900° F., preferably from about 650° F. to about 850° F., and at a pressure from about 500 psig to about 4000 psig. Typical hourly space velocities are in the order of from about 0.3 to about 4.0 hours $^{-1}$.

The hydroliquefaction is generally effected in the presence of a suitable hydroliquefaction catalyst, which is generally either a group 6b or group 8 metal oxide and/or sulfide, supported on a suitable support, such as alumina or silica-alumina. The hydroliquefaction is preferably effected in an up-flow expanded bed.

As hereinabove noted, the details of such a process are disclosed in U.S. Pat. No. 4,028,221, and no further explanation in this respect is deemed necessary for a complete understanding of the present invention.

The liquid produced in the hydroliquefaction includes insoluble components, including coal ash, which are separated from the liquid fraction. In particular, in effecting such removal of insoluble material, the coal liquefaction product is separated into an essentially ash-free coal liquid fraction, and an ash-containing coal liquid fraction. Such separation may be effected by any one of a wide variety of procedures known in the art, including settling, centrifugation, filtration and the like. In accordance with a preferred procedure, such separation is effected by the use of a liquid promoter of the type described in U.S. Pat. No. 3,856,675 and in the aforesaid U.S. Pat. No. 4,028,221. As described, the promoter liquid has a characterization factor (K) of at least about 9.75, and preferably at least about 11.0. The promoter liquid which is employed to enhance and promote the separation of the insoluble material from the coal liquefaction product is further characterized by a 5 volume percent distillation temperature of at least 250° F. and a 95 volume percent distillation temperature of at least about 350° F. and no greater than about 750° F., with the promoter liquid preferably having a 5 volume percent distillation temperature of at least about 310° F. and most preferably of at least about 400° F. The 95 volume percent distillation temperature is preferably no greater than about 600° F. The promoter liquid is generally employed in an amount to provide a promoter liquid to coal liquefaction product weight ratio of from about 0.5 to about 1.0.

In accordance with the present invention, the ash-containing liquid fraction is subjected to delayed coking, as hereinabove described, to produce a soft coke suitable as a blending stock for the production of metallurgical coke.

In accordance with another aspect of the present invention, the essentially ash-free liquid fraction recovered from the coal liquefaction is subjected to delayed coking to produce an anode grade coke. In accordance with this aspect of the invention, the delayed coking for both the ash-free fraction and the ash-containing fraction can be effected with a common coker-fractionator.

In accordance with a particular embodiment of the invention, the soft coke produced in accordance with the invention is blended with bituminous coal and subjected to high temperature carbonization to produce metallurgical coke. The use of soft coke produced in accordance with the invention increases the abrasion resistance of the resulting metallurgical coke.

More particularly, the blend of soft coke and bituminous coal is carbonized at a temperature of from 900° C. to 1200° C. and at essentially atmospheric pressure to produce a metallurgical coke. Carbonization times are in the order of from 10 to 20 hours. The conditions are generally known in the art and such conditions have equal applicability to coking of the blend as hereinabove described. In general, the ratio of soft coke produced in accordance with the invention to coal in the blend is from 0.1:1 to 1.0:1, by weight. The selection of optimum blend ratios and carbonization conditions is deemed to be within the scope of those skilled in the art from the teachings herein.

The invention will be further described with respect to an embodiment thereof illustrated in the accompanying drawing, wherein:

The drawing is a simplified schematic flow diagram of an embodiment of the present invention.

Referring now to the drawing, a ground sub-bituminous and/or lignitic coal, such as brown coal, in line 10, and a pasting solvent in line 11 are introduced into a coal liquefaction zone schematically generally indicated as 12. The coal should preferably have an ash content in the order of from about 1 to about 3 percent by weight on a dry basis. In coal liquefaction zone 12, the coal is liquefied in order to provide a coal liquefaction product, comprised of a coal derived liquid, including insoluble components, in particular, ash, which is withdrawn from the coal liquefaction zone 12 through line 13.

The coal liquefaction may be effected as known in the art, and is preferably effected as described in U.S. Pat. No. 4,028,221. As described in such patent, the liquefaction is effected by initially heat soaking the coal, followed by hydroliquefaction in the presence of a pasting solvent, and such hydroliquefaction may be effected in the presence of a suitable hydroliquefaction catalyst. In view of the fact that the hydroliquefaction does not, per se, form a part of the present invention, and in view of the fact that the aforementioned patent describes such a hydroliquefaction procedure, no further details in this respect is deemed necessary for a complete understanding of the present invention.

The hydroliquefaction product, including insoluble components, in line 13 is then introduced into an ash removal and recovery zone, schematically generally indicated as 14. Such ash removal and recovery may be effected as described in U.S. Pat. No. 4,018,221. As described in such patent, the liquefaction product is subjected to an initial distillation to separate lighter components therefrom; in particular, those components boiling up to about the final boiling point of a deashing promoter liquid which is to be employed in the subsequent deashing step, with such components being those which are more volatile than about 550° F. to about 600° F. After separation, of such volatile components, the liquefaction product is mixed with a deashing promoter liquid, of the type hereinabove described, and introduced into a deashing zone to separate an essentially ash-free product from a product containing coal ash. In general, such deashing is effected by the use of one or more gravity settlers to recover an overflow product, essentially free of insoluble material, and an underflow product containing ash. Promoter liquid is then separated from both the underflow and overflow product by distillation, and in addition, a portion of the overflow product is recovered for use as the pasting solvent in the hydroliquefaction. Ash containing coal derived liquid is recovered through line 15, and deashed coal derived liquid is recovered through line 16. The ash containing liquid is in the form of a pumpable slurry.

Although the deashed coal liquid and the ash containing coal liquid are preferably recovered by the procedure hereinabove described, it is to be understood that other procedures for separating the coal liquefaction product into an ash containing and deashed liquid stream can be employed within the spirit and scope of the present invention. Thus, for example, alternative ash separation methods, such as filtration, centrifugation, vacuum distillation and the like may be employed for obtaining the deashed coal liquid and the ash containing coal liquid. In the case of mechanical ash separation, the ash containing stream must retain sufficient liquid to render such stream pumpable through a delayed coking heater. As a result, in some cases, it may be necessary to add some diluent to the filter cake or centrifuge residue, such as heavy oil, to provide a pumpable stream.

The ash containing liquid in line 15 is combined with recycle in line 20, obtained as hereinafter described, and the combined stream in line 17 passed through a coking heater 18 of the type generally employed in a delayed coking operation. In the coking heater, the ash containing coal derived liquid is heated to a temperature in the order of from about 410° C. to about 450° C.

The heater outlet temperature is selected to provide a soft coke having a volatile matter content of above 16% to 30%, all by weight.

As known in the art, the coking heater is operated in a manner such that the liquid is passed therethrough at a high velocity.

The heated ash containing coal derived liquid in line 19 is introduced into a coke drum schematically generally indicated as 21, operated at an outlet vapor temperature in the order of from about 400° C. to about 430° C., and pressure in the order of from about 15 psig to about 120 psig to effect adiabatic delayed coking to a soft coke suitable as a blending stock for the production of metallurgical coke, having the hereinabove described characteristics. Although only a single coke drum is shown, it is to be understood that there may be more than one coke drum, and in general, two such coke drums are employed in a block feed type arrangement.

Volatiles produced during the coking are withdrawn from coke drum 21 through line 22 for introduction into a combined coker-fractionator 23, as hereinafter described.

The deashed coal liquid in line 16 is combined with ash free recycle in line 24, obtained as hereinafter described, and the combined stream in line 25 passed through a coking heater of the type employed in a delayed coking process to effect heating thereof to a temperature in the order of from about 455° C. to about 510° C. The heated stream in line 27 is introduced into a coke drum 28, operated at an overhead temperature in the order of from about 435° C. to about 460° C., and a pressure in the order of about 15 psig to about 120 psig to effect adiabatic delayed coking thereof to a low ash green coke suitable for aluminum anode production. As implied in the diagram, two coke drums are used for each coke type, with one drum receiving heater charge and filling with coke, while the other drum is being decoked and readied for another on-stream cycle. As is well known in the art, the same two coke drums can be used to produce the two different types of coke by operating the plant in block-out feed fashion. Alternatively, four or more coke drums could also be used if blocked-out operation is not deemed desirable.

Volatiles generated during the delayed coking are withdrawn from coke drum 28 through line 29 for introduction into the combined coker-fractionator 23.

The coker-fractionator 23 is divided into a main section 31 and a lower section 32, with the lower section being in only gas flow communication with the main section, 31; i.e., liquid does not flow from section 31 to section 32.

The vapors generated in the coking of the ash containing coal derived liquid are introduced into the lower section 32 via line 22 and treated to separate any ash matter therein as an ash-containing liquid stream which is recycled through line 20 to the coking operation. The ashy matter may be conveniently separated from the vapor by the use of a wash liquid; e.g., by passing a portion of the recycle through line 41, including cooler 42. The gases are passed from lower section 32 to main section 31 through line 34. It is to be understood that such separation could be effected in a separate vessel.

The vapors generated in the coking of deashed coal liquid are introduced via line 29 into main section 31 wherein an ash free liquid suitable as a coking feedstock is recovered and recycled to the coking operation through line 24. Such coking feedstock generally has an initial boiling temperature of at least 600° F.

Components recovered from both coking operations; i.e., coking of the ash-containing coal derived liquid and coking of the deashed coal liquid, not suitable as a recycle to the coking operation, are fractionated together to recover such components; e.g., a combined coker distillate through line 35 and combined coker gases, naphtha, etc., through line 36. The coker-combination fractionator is operated as known in the art; e.g., at an overhead temperature of from 250° F. to about 350° F., a bottoms chimney temperature of from about 600° F. to about 800° F. and a pressure of from 5 psig to about 115 psig.

The soft coke recovered from coking drum 21, in line 51 may be blended with bituminous coal in line 52 and the blend introduced into a high temperature carbonization zone 53 to produce a metallurgical coke, as hereinabove described. It is to be understood that the soft coke may be employed as a blend stock for the production of metallurgical coke at the plant location where produced or may be recovered as a separate product for sale to manufacturers of metallurgical coke.

In this manner, it is possible to produce soft coke and an anode grade coke from coal, with the added advantage that there is employed a single coker-fractionator.

It is to be understood that the present invention could be employed to produce only soft coke, instead of both soft coke and anode grade coke.

As a further modification, the pasting or liquefaction solvent could be recovered in the coker-fractionator for recycle to the liquefaction zone, instead of effecting such recovery prior to the coking operation.

Similarly, the ash free liquefaction product can be introduced into the coker-fractionator to separate lighter components prior to passage through the coking heater.

These and other such modifications should be apparent to those skilled in the art from the teachings herein.

The present invention is particularly advantageous in that it is possible to produce a soft coke by delayed coking of the ash-containing stream produced in a process directed to the hydroliquefaction of a brown or lignitic coal. Such soft coke is advantageously used as a blending component with a mixture of bituminous coals charged to high temperature carbonization ovens. In this manner, there is a reduction in the quantity of expensive bituminous coal used for such coke ovens, and an improvement in the abrasion resistance of the metallurgical coke.

Numerous modifications and variations of the present invention are possible in light of the above teachings and, therefore, within the scope of the appended claims, the invention may be practised otherwise than as particularly described.

We claim:

1. In a process for the liquefaction of a coal selected from the group consisting of sub-bituminous and lignitic coals, wherein there is recovered an ash free coal liquid and an ash-containing coal liquid, the improvement comprising:

passing the ash containing coal liquid through a coking heater to effect heating thereof to an outlet temperature of from about 410° C. to about 450° C., and adiabatically effecting delayed coking of said heated ash-containing coal liquid at a pressure of from about 15 psig to about 120 psig, to produce an ash-containing soft coke having a combustible volatile matter content of from above 16 to no greater than 30 weight percent suitable as blending stock with coal for the production of metallurgical coke.

2. The process of claim 1 and further comprising:

passing the ash free coal liquid through another coking heater to effect heating thereof to an outlet temperature of from about 455° C. to about 510° C. and effecting adiabatic delayed coking of said heated ash free coal liquid to produce anode grade coke.

3. The process of claim 2 and further comprising:

recovering vapors from the delayed coking of the ash-containing liquid; separating ashy matter from said vapors as an ash-containing liquid which is recycled to the said coking heater; introducing ash free vapors and vapors from said delayed coking of the ash free liquid into a combination coker fractionator to effect recovery of an ash free cokable liquid stream and distillates and lighter components and passing said ash free cokable liquid stream to said another coking heater.

4. The process of claim 1 wherein the coking heater is operated at an outlet temperature of from about 415° C. to about 435° C.

5. The process of claim 1 wherein the soft coke has an ash content of from 6 to 20 percent by weight, on a dry basis.

6. The process of claim 1 wherein the coal is a brown coal.

7. The process of claim 3 wherein said coal is a brown coal.

8. The process of claim 7 wherein said coking heater is operated at an outlet temperature of from about 415° C. to 435° C.

9. The process of claim 8 wherein said coker combination fractionator is operated at an overhead temperature of from about 250° F. to about 350° F., a bottoms chimney temperature of from about 600° F. to about 800° F. and a pressure of from about 5 psig to 115 psig.

10. The process of claim 9 wherein ashy matter is separated from the vapors from the delayed coking of the ash-containing liquid in a separate section of the coker combination fractionator.

11. The process of claim 1 and further comprising blending the soft coke with bituminous coal and subjecting the blend to high temperature carbonization to produce a metallurgical coke.

12. The process of claim 11 wherein the weight ratio of soft coke to coal in the blend is from 0.1:1 to 1:1.

13. The process of claim 12 wherein the carbonization is effected at a temperature of from 900° C. to 1200° C.

14. The process of claim 1 wherein the coal is a lignitic coal.

15. The process of claim 1 wherein the coal has an ash content of from 1 to 3 weight percent.

16. A soft coke having a combustible volatile matter content of from above 16 to no greater than 30 percent by weight and an ash content of from 6 to 20 percent by weight, on a dry basis, produced by the process of claim 1.

17. A metallurgical coke produced by the carbonization of a blend of bituminous coal and the soft coke of claim 16.

* * * * *